US006109611A

United States Patent [19]

Aramapakul

[11] Patent Number: 6,109,611

[45] Date of Patent: Aug. 29, 2000

[54] METHOD OF PLAYING A ROULETTE-TYPE CARD GAME

[76] Inventor: Paiboon Aramapakul, 2708 E. 15th St., Long Beach, Calif. 90804

[21] Appl. No.: 09/115,562

[22] Filed: Jul. 15, 1998

[51] Int. Cl.[7] ..... A63F 1/00

[52] U.S. Cl. ..... 273/292

[58] Field of Search ..... 273/292, 309, 273/274; 463/12, 13

[56] References Cited

U.S. PATENT DOCUMENTS

| | | | |
|---|---|---|---|
| 5,423,551 | 6/1995 | Stavinsky | 273/306 |
| 5,692,755 | 12/1997 | Gutierrez | 273/292 |
| 5,713,573 | 2/1998 | Nazaryan | 273/292 |

FOREIGN PATENT DOCUMENTS

| | | | |
|---|---|---|---|
| 1448999 | 8/1966 | France | 273/274 |

OTHER PUBLICATIONS

"Over/Under 13", Gaming Concepts, Inc., 1988.
"Over/Under 13", Copyright Registration, Jan. 1985.
"Triple Royale", Joe Nehmad, Oct. 1997.

*Primary Examiner*—Benjamin H. Layno
*Attorney, Agent, or Firm*—Ted Masters

[57] ABSTRACT

A method of playing a card game allows players to place roulette-type wagers. The players can wager that a majority of dealt cards will be odd or even, red or black, and that the numerical total of the dealt cards will fall within preestablished ranges.

23 Claims, 9 Drawing Sheets

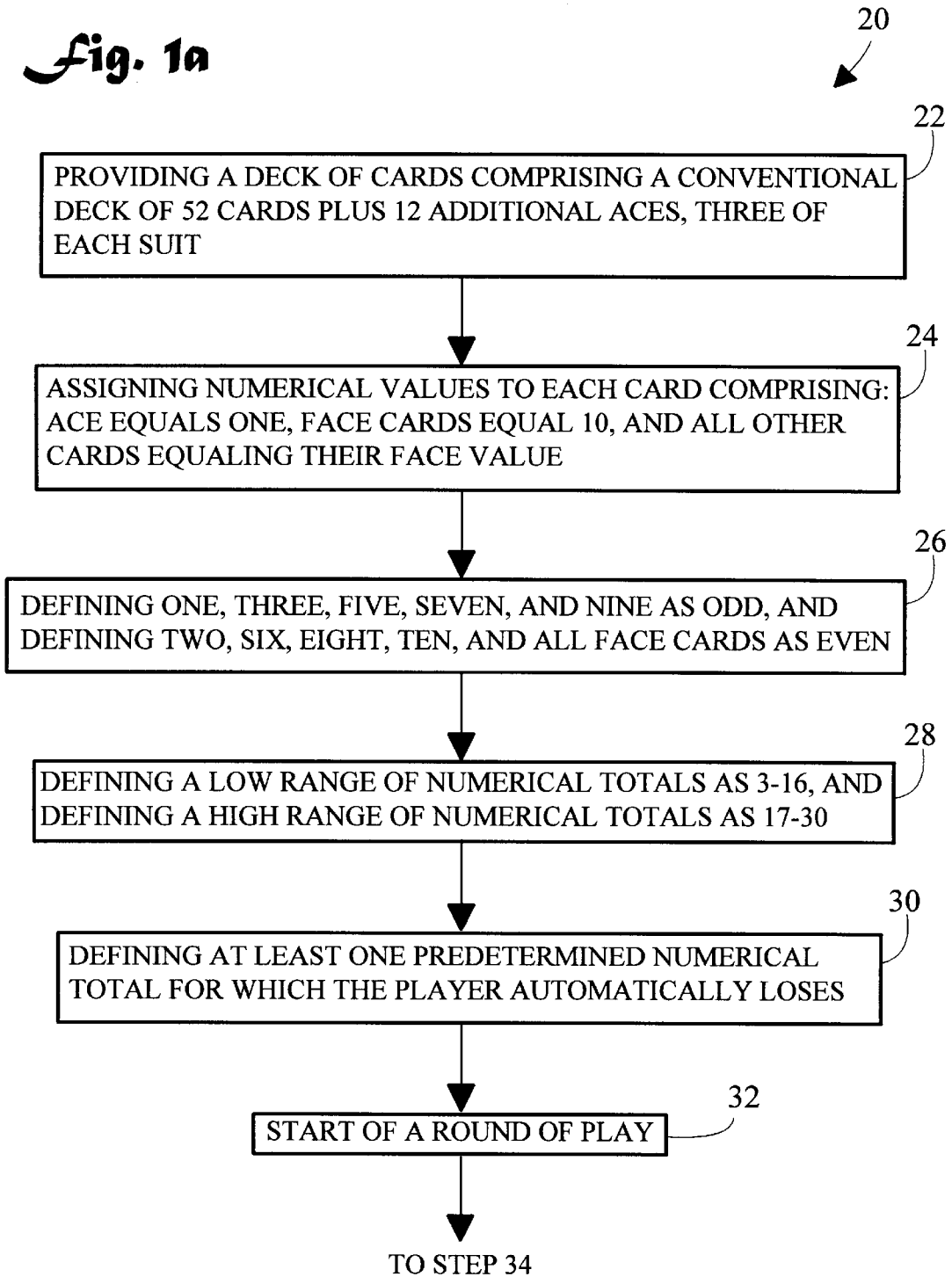
Fig. 1a
20
22
PROVIDING A DECK OF CARDS COMPRISING A CONVENTIONAL DECK OF 52 CARDS PLUS 12 ADDITIONAL ACES, THREE OF EACH SUIT
24
ASSIGNING NUMERICAL VALUES TO EACH CARD COMPRISING: ACE EQUALS ONE, FACE CARDS EQUAL 10, AND ALL OTHER CARDS EQUALING THEIR FACE VALUE
26
DEFINING ONE, THREE, FIVE, SEVEN, AND NINE AS ODD, AND DEFINING TWO, SIX, EIGHT, TEN, AND ALL FACE CARDS AS EVEN
28
DEFINING A LOW RANGE OF NUMERICAL TOTALS AS 3-16, AND DEFINING A HIGH RANGE OF NUMERICAL TOTALS AS 17-30
30
DEFINING AT LEAST ONE PREDETERMINED NUMERICAL TOTAL FOR WHICH THE PLAYER AUTOMATICALLY LOSES
32
START OF A ROUND OF PLAY
TO STEP 34

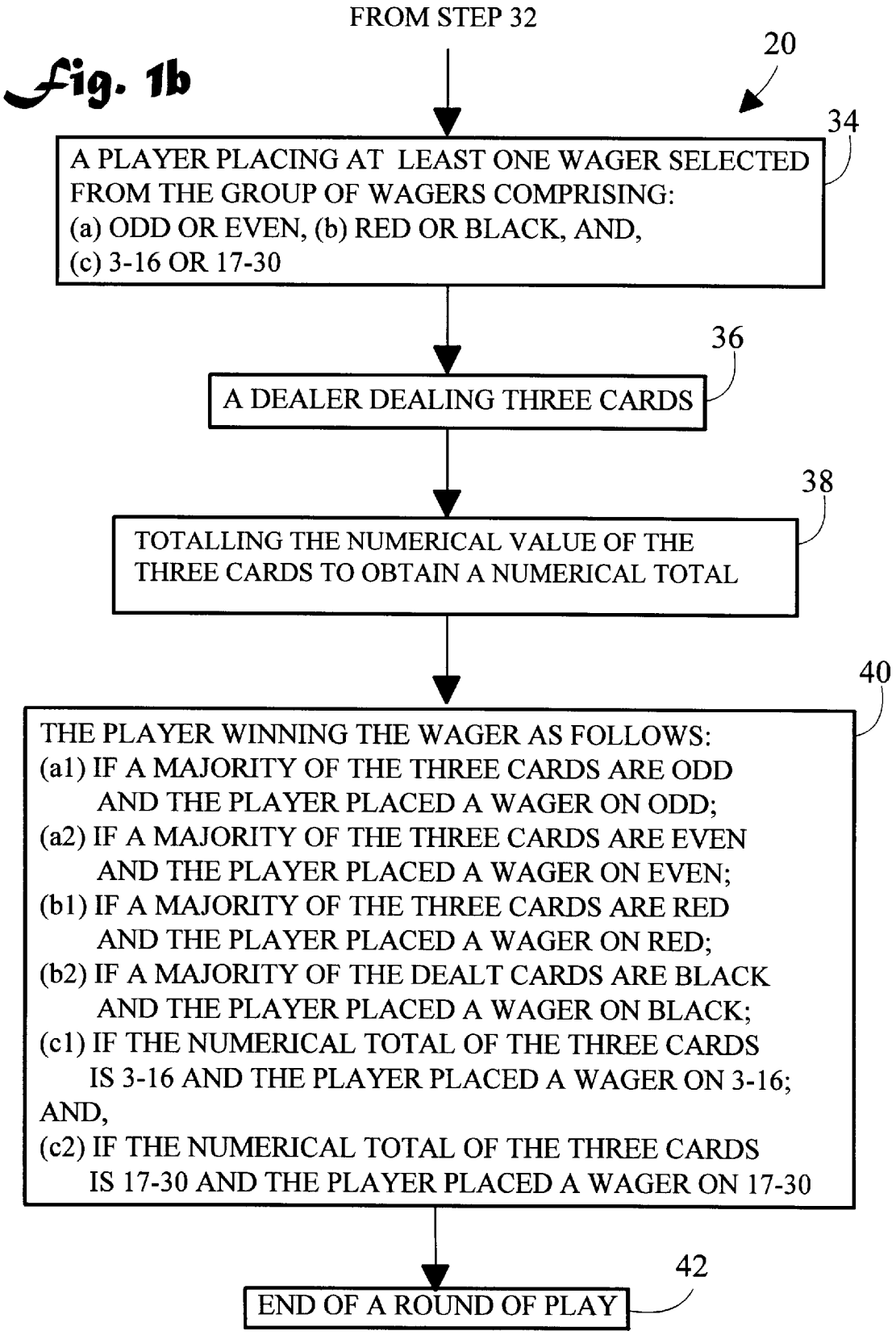
FROM STEP 32
Fig. 1b
20
34
A PLAYER PLACING AT LEAST ONE WAGER SELECTED FROM THE GROUP OF WAGERS COMPRISING:
(a) ODD OR EVEN, (b) RED OR BLACK, AND,
(c) 3-16 OR 17-30
36
A DEALER DEALING THREE CARDS
38
TOTALLING THE NUMERICAL VALUE OF THE THREE CARDS TO OBTAIN A NUMERICAL TOTAL
40
THE PLAYER WINNING THE WAGER AS FOLLOWS:
(a1) IF A MAJORITY OF THE THREE CARDS ARE ODD AND THE PLAYER PLACED A WAGER ON ODD;
(a2) IF A MAJORITY OF THE THREE CARDS ARE EVEN AND THE PLAYER PLACED A WAGER ON EVEN;
(b1) IF A MAJORITY OF THE THREE CARDS ARE RED AND THE PLAYER PLACED A WAGER ON RED;
(b2) IF A MAJORITY OF THE DEALT CARDS ARE BLACK AND THE PLAYER PLACED A WAGER ON BLACK;
(c1) IF THE NUMERICAL TOTAL OF THE THREE CARDS IS 3-16 AND THE PLAYER PLACED A WAGER ON 3-16; AND,
(c2) IF THE NUMERICAL TOTAL OF THE THREE CARDS IS 17-30 AND THE PLAYER PLACED A WAGER ON 17-30
42
END OF A ROUND OF PLAY

504

| | | |
|---|---|---|
| ODD | RED | 3-16 |
| EVEN | BLACK | 17-30 |

METHOD OF PLAYING A ROULETTE-TYPE CARD GAME

TECHNICAL FIELD

The present invention relates generally to card games, and in particular to a card game which incorporates wagering options similar to those of the game of roulette.

BACKGROUND ART

The game of roulette is well known in the gaming art. This game includes a wheel having 38 stations (the numbers 1 through 36, Zero, and Double Zero), and a ball which is cast onto the spinning wheel and alights on one of the stations as the wheel slows down. Half of the 36 numbers are odd and red, and the other half are even and black. Players are afforded the option on placing a variety of wagers including (1) odd or even, (2) red or black, (3) individual numbers, (4) combinations of numbers (eg four numbers), and (5) various ranges of numbers such as 1–12, 13–24, and 25–36. If the ball lands upon Zero (0) or Double Zero (00), the players lose all wagers except wagers specifically placed on these two stations.

The present invention utilizes cards to play a game having roulette-type features. The players can bet upon (1) odd or even, (2) red or black, and (3) low or high ranges of the numerical total of the dealt cards.

DISCLOSURE OF INVENTION

The present invention pertains to a method of playing a wagering card game which allows the players to place roulette-type wagers. Specifically a player can place wagers that a majority of dealt cards will be (a) either red or black, (2) either odd or even, and (3) either within a low range of numerical totals or within a high range of numerical totals. In order to ensure that a majority of the dealt cards are either red or black and either odd or even, the number of dealt cards must always be odd.

In accordance with a preferred embodiment of the invention, a method of playing a card game comprises providing a deck of cards, each card in the deck having an assigned numerical value, each card in the deck being either odd or even, and each card in the deck being either a first color or a second color (e.g. red and black);

In accordance with an important aspect of the invention, a low range of numerical totals (e.g. 3–16), and a high range of numerical totals (e.g. 17–30) are defined;

In accordance with an important feature of the invention, a player places at least one wager selected from a group of wagers comprising:

(a) odd or even;

(b) first color or a second color; and, (c) a low range of numerical totals or a high range of numerical totals;

In accordance with another aspect of the invention, a dealer deals an odd number of cards;

In accordance with another feature of the invention, the numerical values of the dealt cards are summed to obtain a numerical total;

In accordance with an important aspect of the invention, depending upon which wager or wagers the player placed, the player wins the at least one wager as follows;

(a1) if a majority of the dealt cards is odd and the player placed a wager on odd;

(a2) if a majority of the dealt cards is even and the player placed a wager on even;

(b1) if a majority of the dealt cards is the first color and the player placed a wager on the first color;

(b2) if a majority of said dealt cards is the second color and the player placed a wager on the second color;

(c1) if the numerical total of the dealt cards is within the low range of numerical totals and the player placed a wager on the low range of numerical totals; and, (c2) if the numerical total of the dealt cards is within the high range of numerical totals and the player placed a wager on the high range of numerical totals.

In accordance with a preferred embodiment of the invention, the deck of cards comprises a conventional deck of 52 cards plus 12 additional cards, the 12 additional cards having a numerical value of one, six of the 12 additional cards being the first color, and six of the 12 additional cards being the second color.

In accordance with an important aspect of the invention, the numerical values of the cards are ace equals one, face cards equal 10, and all other cards equaling their face value.

In accordance with an important feature of the invention, at least one predetermined numerical total for which the player automatically loses the at least one wager is defined. In a preferred embodiment the predetermined numerical totals are 12 and 21.

In accordance with another aspect of the invention, one, three, five, seven, and nine are odd; and two, four, six, eight, ten, and all face cards are even.

In accordance with a preferred embodiment of the invention, the dealer deals three cards.

In accordance with an important aspect of the invention, the low range of numerical totals is 3–16, and the high range of numerical totals is 17–30.

Other features and advantages of the present invention will become apparent from the following detailed description, taken in conjunction with the accompanying drawings, which illustrate, by way of example, the principles of the invention.

BRIEF DESCRIPTION OF DRAWINGS

FIG. 1 is a flow chart of a preferred embodiment of the present invention;

MODES FOR CARRYING OUT THE INVENTION

Figures 2A, 2B:
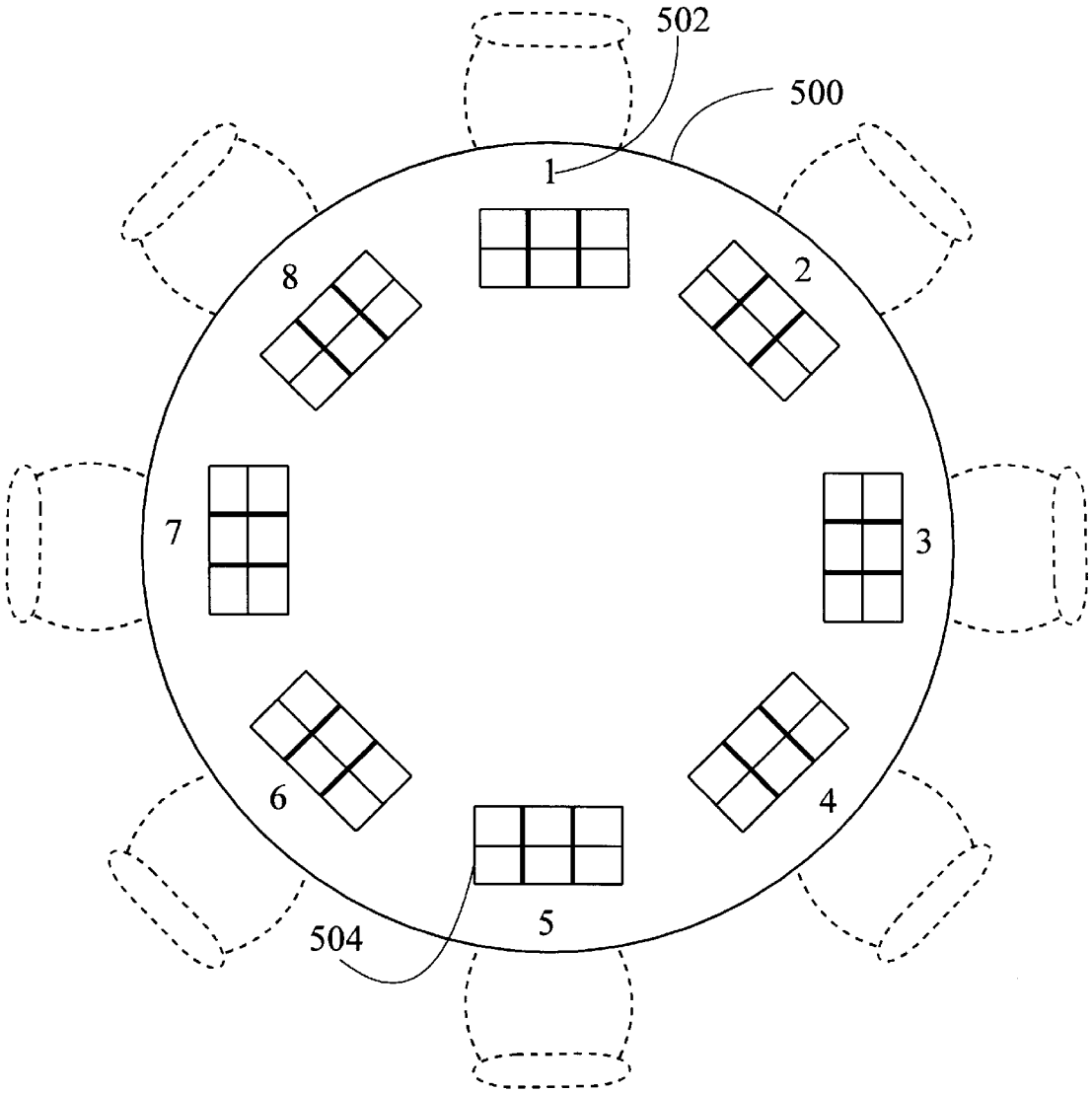
FIG. 2 is a plan view of a playing table layout.

Referring initially to FIG. 1, there is depicted a flow diagram illustrating the steps and method of play of a wagering game in accordance with the present invention, generally designated as 20. In step 22 a deck of playing cards is provided. The deck comprises a conventional deck of 52 cards plus 12 additional cards, thereby forming a 64 card deck. The 12 additional cards have a numerical value of one, and in a preferred embodiment comprise 12 aces, three of each playing suit (spades, hearts, diamonds, and clubs). Six of the 12 additional cards are a first color (typically red), and six of the 12 additional cards are a second color (typically black).

In step 24, numerical values are assigned to each card in the deck. The numerical values are ace equals one, face cards equal 10, and all other cards equaling their face value. In step 26, odd and even cards are defined. The odd cards are one, three, five, seven, and nine. The even cards are two, four, six, eight, ten, and all face cards. In step 28, a low range of numerical totals is defined as being 3–16, and a high range of numerical values if defined as being 17–30. In step 30, at least one predetermined numerical total for which the player automatically loses all of his or her wagers is defined. In a preferred embodiment, two predetermined numerical totals of 12 and 21 are defined. This is analogous to the "0" and "00" in roulette, wherein the gaming establishment automatically wins when these numbers come up unless the player has made a specific wager on these numbers. In the present invention, if a player places an additional wager on either of the predetermined numerical totals (12 or 21), and that number is ultimately achieved (see step 38 below), the player wins the additional wager and is paid off (for example at 10 to 1). Another possible method of achieving an advantage for the gaming establishment would be to add one or more "lose cards" to the deck, such as Jokers. If a loose card is dealt, the player would automatically loose all wagers.

In step 32 a round of play commences. In step 34 a player places at least one wager selected from a group of wagers comprising: (a) odd or even, (b) the first color or the second color, and (c) the low range of numerical values (3–16) or the high range of numerical values (17–30). That is, the player could place only one wager on any of the three wagering options, two wagers on any two of the wagering options, or place three wagers one on each wagering option. In step 36 a dealer deals three cards. The three cards are preferably dealt face up on the playing table, but could also initially be dealt face down and subsequent turned face up. The present invention could also be played by dealing one card, five cards, seven cards, etc. so long as the number of dealt cards is odd.

In step 38 the numerical values of all of the three dealt cards are totaled to arrive at a numerical total. Since the numerical values range from one to 10, the possible numerical totals range from 3–30. In step 40, the player wins the placed wager(s) under any of the following circumstances:

(a1) if a majority of the three dealt cards is odd and the player placed a wager on odd;

(a2) if a majority of the three dealt cards is even and the player placed a wager on even;

(b1) if a majority of the three dealt cards is said first color and the player placed a wager on said first color;

(b2) if a majority of the three dealt cards is said second color and the player placed a wager on said second color;

(c1) if the numerical total of the three dealt cards is within the low range of numerical totals (3–16) and the player placed a wager on the low range of numerical totals; and, (c2) if the numerical total of the three dealt cards is within the high range of numerical totals (17–30) and the player placed a wager on the high range of numerical totals.

Because an odd number of cards was dealt, three in the preferred embodiment, there will always be a majority (two out of three, or three out of three) of odd cards or even cards, and of first color cards or second color cards.

In step 42, the round of play is concluded.

As an example of the play of the present invention, assume that the player places wagers on the first color (red) and on even, and that the three dealt cards are the two of diamonds, the king of spades, and the five of hearts. Since two (a majority) of the three cards are red (the two of diamonds and the five of hearts), the player wins the color wager. Also, since two of the three cards are even (the two of diamonds and the king of spades), the player also wins the odd/even wager. Since no wager was placed on the range of numerical totals, no wager is won or lost on that option. If the player had placed a wager on the high range (17–30) of numerical totals, he or she would have won since the numerical total of the three dealt cards was 17 (2+10+5). Finally, if the three dealt cards had been the two of diamonds, the king of spades, and the nine of hearts, the player would have automatically lost both wagers since the numerical total of the three cards is one of the predetermined numerical totals 21 (2+10+9), (even though the color wager was correct).

It may be appreciated that numerous playing variations and combinations could be applied to the fundamental principles of the present invention. For example the two colors of the cards could be other than red and black, the deck could comprise multiple decks, Jokers could be added to the deck instead of aces, one or more additional cards could be added to the deck. For example one or more "wild cards" could be added which could be used at the player's discretion, for example to be either red or black, odd or even, or any numerical value, etc. Also, other numerical values could be assigned to each card. The method of the present invention may be practiced by a single player or by multiple players, wherein the player(s) play against a house dealer, against a player banker, or each other in a no bank format. Also, the low (3–16) and high (17–30) ranges of numerical totals could be further partitioned to comprise four wagering ranges 3–9, 10–16, 17–23, and 24–30.

In terms of payoff, each of the three wagering options pay off at 1 —1. If the player places an additional wager on a predetermined numerical total for which the player loses all of the three wagering options, a much higher payoff is preferred (for example 10-1). For three dealt cards, the probabilities of occurrence of each numerical total are provided in Table 1.

TABLE 1

| Total Numerical Value | Percent of Occurrence |
|---|---|
| 3 | 1.40 |
| 4 | 1.17 |
| 5 | 1.39 |
| 6 | 1.78 |
| 7 | 2.05 |
| 8 | 2.47 |
| 9 | 2.81 |
| 10 | 3.29 |
| 11 | 3.69 |
| 12 | 7.83 |
| 13 | 5.32 |
| 14 | 5.48 |
| 15 | 5.62 |
| 16 | 5.60 |
| 17 | 5.64 |
| 18 | 5.60 |
| 19 | 5.52 |
| 20 | 5.36 |
| 21 | 7.83 |
| 22 | 3.69 |
| 23 | 3.30 |
| 24 | 2.81 |
| 25 | 2.48 |
| 26 | 2.08 |
| 27 | 1.80 |
| 28 | 1.40 |
| 29 | 1.17 |
| 30 | 1.40 |

FIG. 2 is a plan view of a playing table layout. Playing table 500 includes a plurality of playing positions 502, eight in the shown embodiment. This playing table layout is most compatible when game (20) includes a plurality of players play against a player-banker or playing a no-bank game, however the principles of the present invention can also be practiced with players playing against a house dealer on a table layout similar to blackjack. Indicia depicting a wagering area 504, playing positions 502, or other pertinent information can be disposed upon the surface of playing table 500 or a covering thereof. Wagering area 504 is used to place wagers or bets, which in a preferred embodiment are (a) either odd or even, (b) red or black, and (3) low range of numerical totals 3–16 or high range of numerical totals 17–30.

Figure 3A:
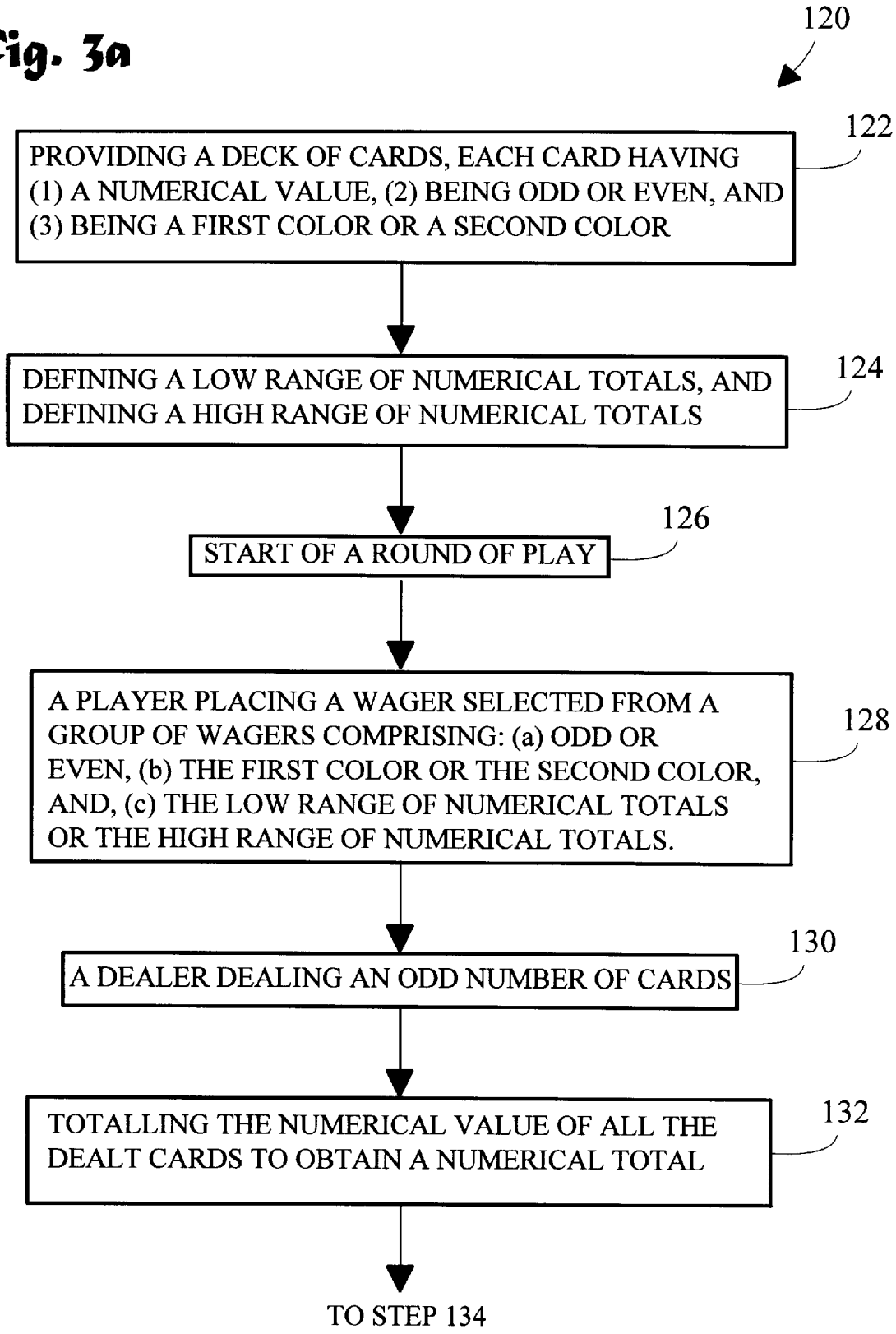
FIG. 3 is a flow chart of a general embodiment of the invention.
Figure 3B:
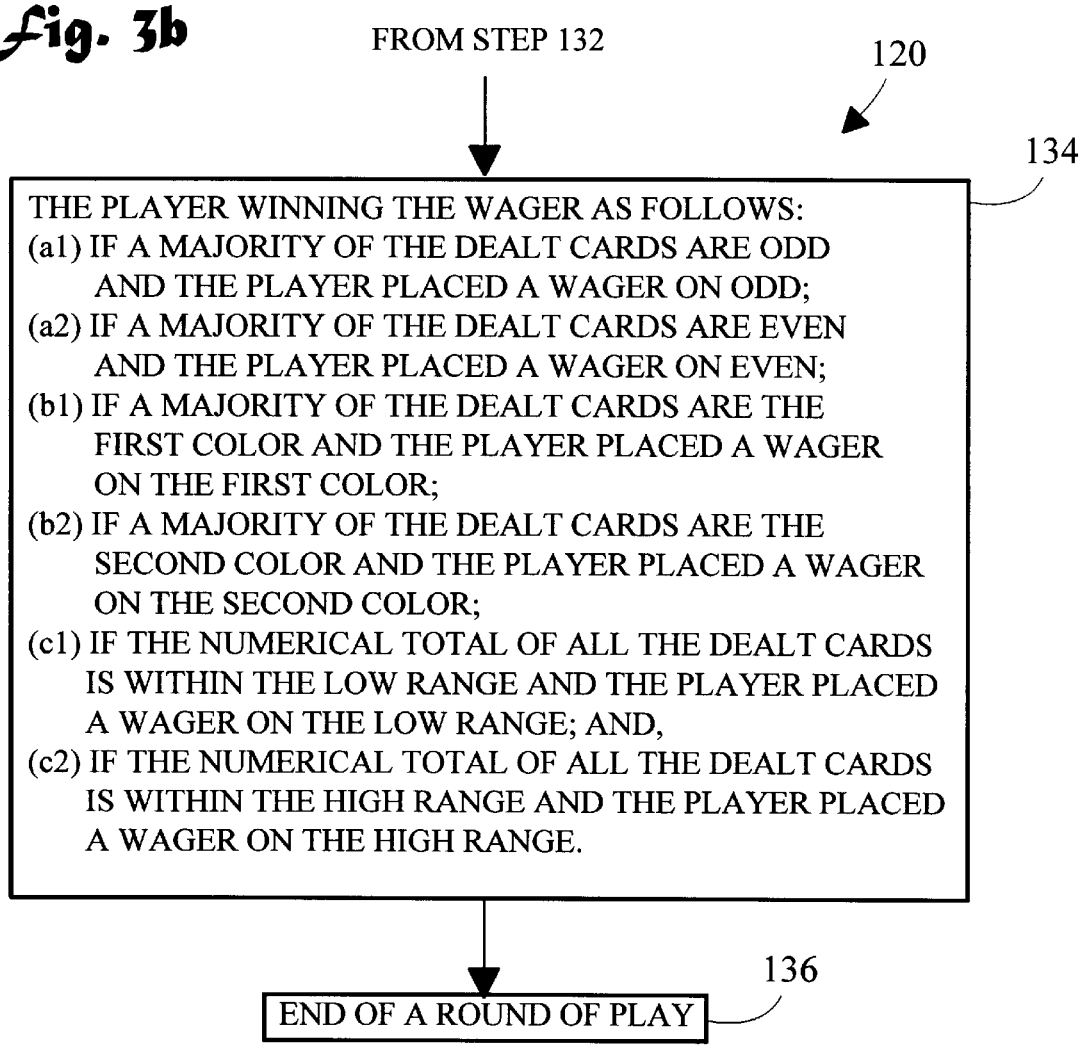

Now referring to FIG. 3, there is illustrated a flow chart of the steps and method of playing a general embodiment of the present invention, generally designated as 120. In step 122, a deck of playing cards is provided. Each card in the deck (1) has an assigned numerical value, (2) is either odd or even, and (3) is a first color or a second color. In step 124 a low range of numerical totals is defined, and a high range of numerical totals is defined. In step 126, a round of play commences. In step 128 a player places at least one wager selected from a group of wagers comprising (a) odd or even, (b) the first color or the second color, and (c) the low range of numerical values or the high range of numerical values. In step 130, a dealer deals out an odd number of cards. In step 132 the numerical values of all of the dealt cards are totaled to arrive at a numerical total. In step 134, the player wins the at least one wager under any of the following circumstances:

(a1) if a majority of said dealt cards is odd and the player placed a wager on odd;

(a2) if a majority of said dealt cards is even and the player placed a wager on even;

(b1) if a majority of said dealt cards is said first color and the player placed a wager on said first color;

(b2) if a majority of said dealt cards is said second color and the player placed a wager on said second color;

(c1) if the numerical total of the dealt cards is within said low range of numerical totals and the player placed a wager on the low range of numerical totals; and, (c2) if the numerical total of said dealt cards is within the high range of numerical totals and the player placed a wager on the high range of numerical totals.

In step 136, the round of play is concluded.

It is noted that while dealing three cards is a preferred embodiment of the present invention, the principles of the present invention may be practiced with other odd numbers of dealt cards as well. For example, if only one card is dealt the first or second color wager still applies. However, since there are 13 different cards in a conventional deck, the odd or even wager requires modification in order to make the odd and even probabilities the same. One possible method of accomplishing this would be to define one of the 13 different cards as being a "neutral card" (i.e. neither odd nor even) wherein if that card is dealt the odd/even wager is a push. For example the seven could be designated as neutral, with ace-three-five-nine-jack-king being odd, and two-four-six-eight-ten-queen being even. Similarly, for the low range/high range wager with one dealt card, one card could be designated as neutral (e.g. the seven), with ace through six being low, and eight through king being high.

Figure 4:
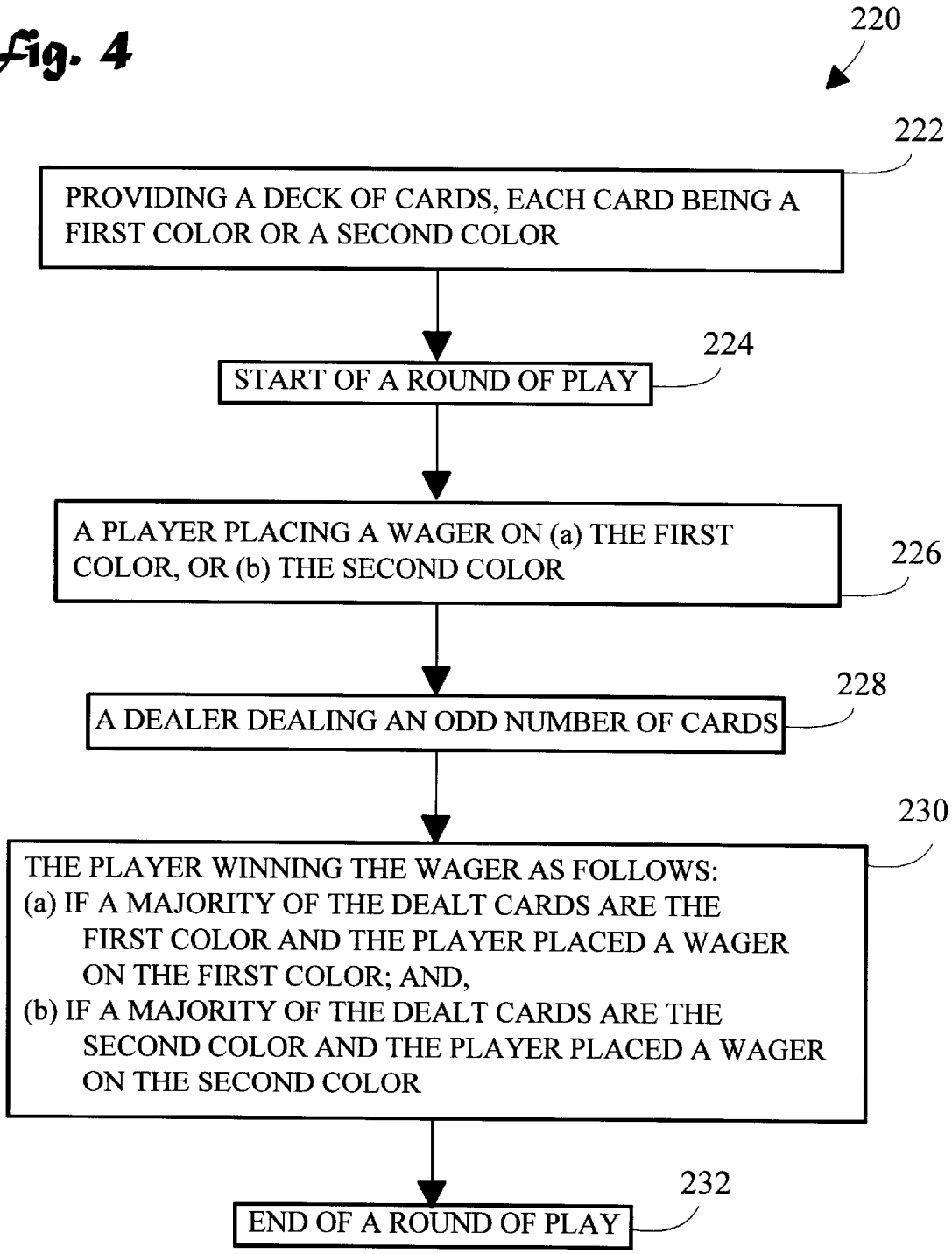
FIG. 4 is a flow chart of wagering on color only.

Now referring to FIG. 4, there is illustrated a flow chart of a method of practicing the present invention wherein a player only wagers on a first color or a second color, the method generally designated as 220. This version is a simplified version of method 120 which only offers the first or second color wagering option. In step 222, a deck of cards is provided, each card in the deck being either a first color (typically red) or a second color (typically black). In step 224 a round of play is started. In step 226 a player places a wager on either (a) the first color, or (b) the second color. In step 228, a dealer deals an odd number of cards. The player wins the wager:

(a) if a majority of the dealt cards is the first color and the player placed a wager on the first color; and, (b) if a majority of the dealt cards is the second color and the player placed a wager on the second color.

In step 232, the round of play is concluded.

Figure 5:
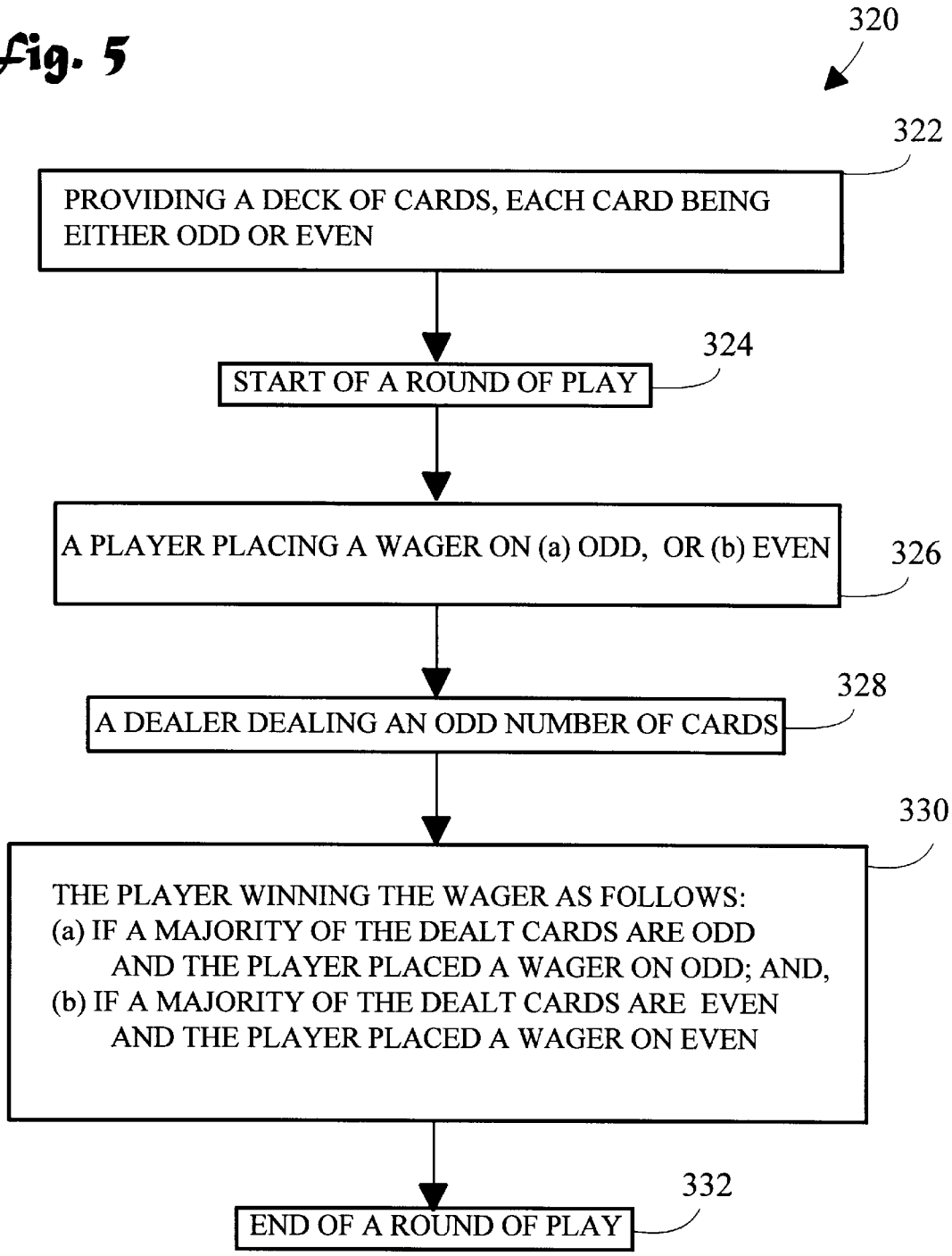
FIG. 5 is a flow chart of wagering on odd or even only.

Now referring to FIG. 5, there is illustrated a flow chart of a method of practicing the present invention wherein a player only wagers on odd or even, the method generally designated as 320. This version is also a simplified version of method 120 which only offers the odd or even wagering option. In step 322, a deck of playing cards is provided, each card being either odd or even. In step 324 a round of play is started. In step 326 a player places a wager on either (a) odd, or (b) even. In step 328, a dealer deals an odd number of cards. In step 330, the player wins the wager:

(a) if a majority of the dealt cards is odd and the player placed a wager on odd; and, (b) if a majority of the dealt cards is even and the player placed a wager on even.

In step 332, the round of play is concluded.

Figure 6A:
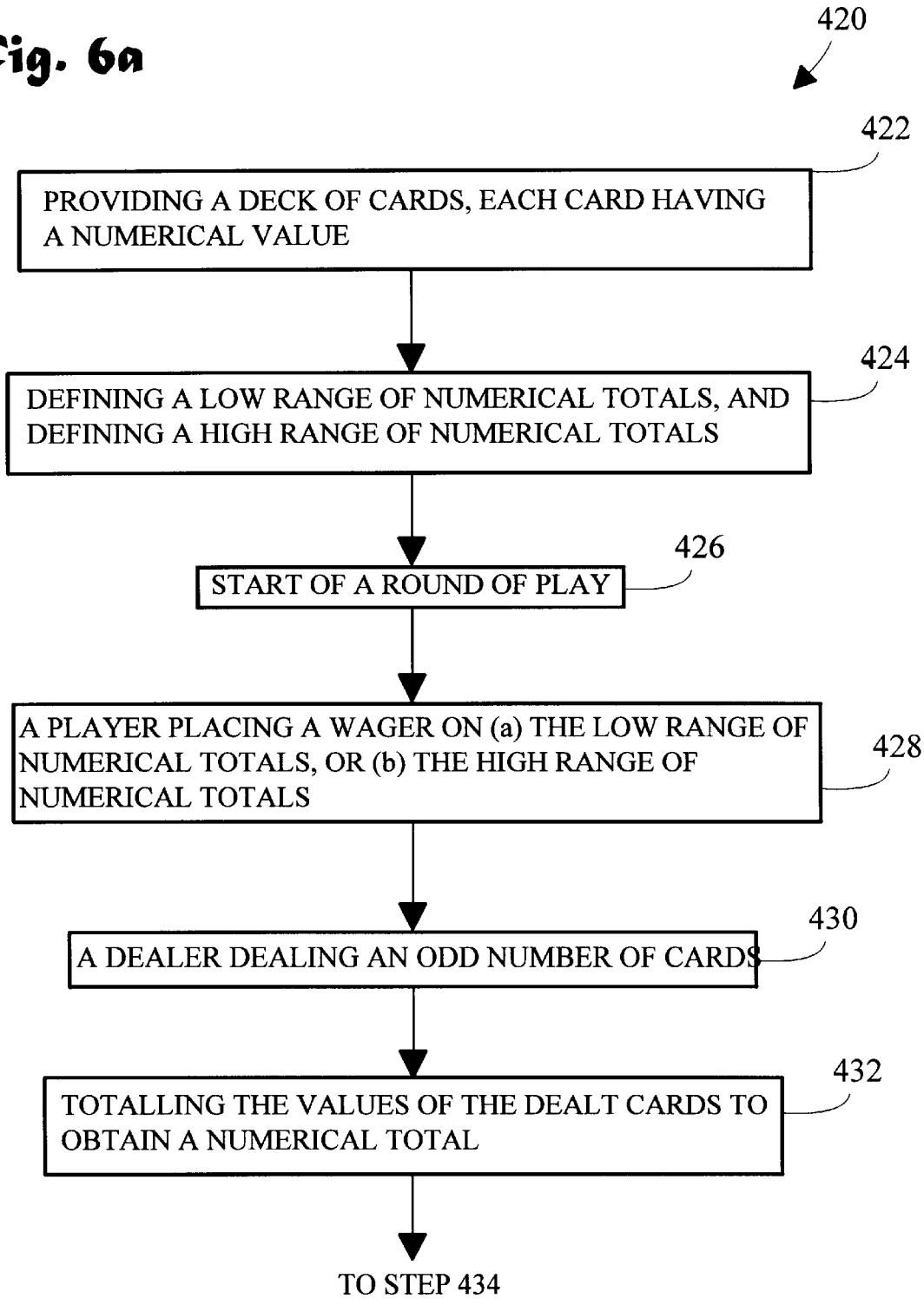
FIG. 6 is a flow chart of wagering on a low or high numerical total only.
Figure 6B:
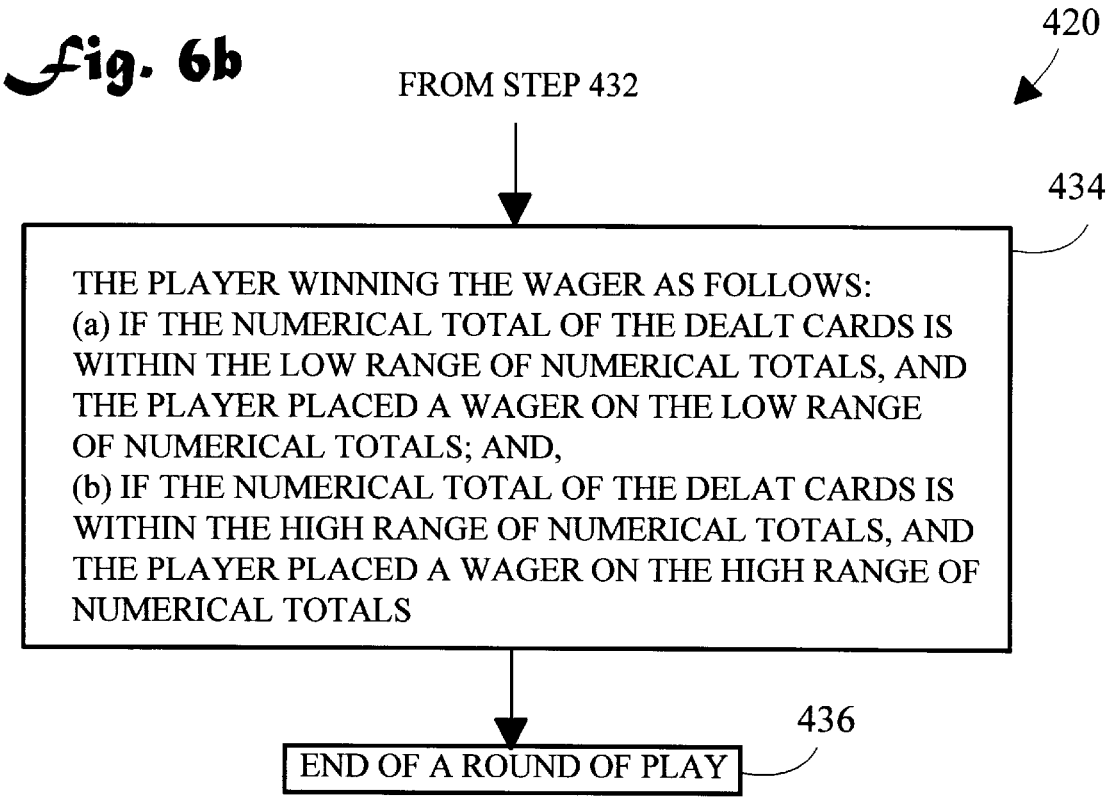

Now referring to FIG. 6, there is illustrated a flow chart of a method of practicing the present invention wherein a player only wagers on a low range of numerical totals or a high range of numerical totals, the method generally designated as 420. This version is also a simplified version of method 120 which only offers the low and high range of numerical totals wagering option. In step 422, a deck of cards is provided, each card having a numerical value. In step 424, a low range of numerical totals is defined, and a high range of numerical totals if defined. In step 426, a round of play is started. In step, 428, a player places a wager on either (a) the low range of numerical totals, or (b) the high range of numerical totals. In step 430, a dealer deals an odd number of cards. In step 432, the numerical values of the dealt cards are totaled to obtain a numerical total. In step 434, the player wins the wager:

(a) if the numerical total of the dealt cards is within the low range of numerical totals and the player placed a wager on the low range of numerical totals; and, (b) if the numerical total of the dealt cards is within the high range of numerical totals and the player placed a wager on the high range of numerical totals.

In step 436, the round of play is concluded.

It may be appreciated that the methods of FIGS. 4–6 could also employ defining at least one predetermined numerical total for which the player automatically loses the wager, as is contained in method 20. This would enable a gaming establishment to realize a profit. Or alternatively, one or more "lose cards", such as Jokers, could be added to the deck. Also, one or more wild cards could be added to the deck, as was described in method 20.

The preferred embodiments of the invention described herein are exemplary and numerous modifications, dimensional variations, and rearrangements can be readily envisioned to achieve an equivalent result, all of which are intended to be embraced within the scope of the appended claims.

I claim:

1. A method of playing a card game, comprising the steps of:

providing a deck of cards, each card in said deck having a numerical value, each card in said deck being either odd or even, and each card in said deck being either a first color or a second color;

defining a low range of numerical totals, and defining a high range of numerical totals;

a player placing at least one wager selected from a group of wagers comprising:

(a) odd or even;

(b) said first color or said second color; and, (c) said low range of numerical totals or said high range of numerical totals;

a dealer dealing an odd number of cards;

totaling the numerical values of said dealt cards to obtain a numerical total;

the player winning said at least one wager as follows;

(a1) if a majority of said dealt cards is odd and the player placed a wager on odd;

(a2) if a majority of said dealt cards is even and the player placed a wager on even;

(b1) if a majority of said dealt cards is said first color and the player placed a wager on said first color;

(b2) if a majority of said dealt cards is said second color and the player placed a wager on said second color;

(c1) if the numerical total of said dealt cards is within said low range of numerical totals and the player placed a wager on said low range of numerical totals; and, (c2) if the numerical total of said dealt cards is within said high range of numerical totals and the player placed a wager on said high range of numerical totals.

2. The method according to claim 1, further including;

said deck of cards comprising a conventional deck of 52 cards plus 12 additional cards, said 12 additional cards having a numerical value of one, six of said 12 additional cards being said first color, and six of said 12 additional cards being said second color.

3. The method according to claim 2, further including;

said 12 additional cards comprising 12 aces.

4. The method according to claim 1, wherein said numerical values are ace equals one, face cards equal 10, and all other cards equaling their face value.

5. The method according to claim 4, further including the step of:

defining at least one predetermined numerical total for which the player automatically loses said at least one wager.

6. The method according to claim 5, said at least one predetermined numerical total being 12 and 21.

7. The method according to claim 5, further including the steps of:

the player placing an additional wager on said at least one predetermined numerical total; and, the player winning said additional wager if said numerical total equals said predetermined numerical total.

8. The method according to claim 1, further including;

one, three, five, seven, nine being odd; and two, four, six, eight, ten, and all face cards being even.

9. The method according to claim 1, further including:

the dealer dealing three cards.

10. The method according to claim 9, further including:

said numerical values being ace equals one, face cards equal 10, and all other cards equaling their face value;

said low range of numerical totals being 3–16; and, said high range of numerical totals being 17–30.

11. The method according to claim 10, further including:

said low range of numerical totals including a 3–9 range and a 10–16 range;

said high range of numerical totals including a 17–23 range and a 24–30 range; and, the player placing said at least one wager said 3–9 range on at least one of said 3–9, 10–16, 17–23, and 24–30 ranges.

12. The method according to claim 1, said first color being red, and said second color being black.

13. The method according to claim 1, further including:

said deck of cards comprising a conventional deck of 52 cards plus 12 additional aces, three of each suit;

wherein said numerical values are ace equals one, face cards equal 10, and all other cards equaling their face value;

wherein one, three, five, seven, nine are odd, and two, four, six, eight, ten, and all face cards are even;

said low range of numerical totals being 3–16, and said high range of numerical totals being 17–30;

defining at least one predetermined numerical total for which the player automatically loses said at least one wager; and, the dealer dealing three cards.

14. The method according to claim 1, further including at least one additional card added to said deck.

15. The method according to claim 14, wherein said at least one additional card includes at least one wild card.

16. The method according to claim 14, wherein said at least one additional card includes at least one "lose card" which the player automatically loses said at least one wager.

17. A method of playing a card game, comprising the steps of:

providing a deck of cards, each card in said deck being either odd or even;

a player placing a wager on either (a) odd, or (b) even;

a dealer dealing an odd number of cards;

the player winning said wager as follows;

(a) if a majority of said dealt cards is odd and the player placed a wager on odd; and, (b) if a majority of said dealt cards is even and the player placed a wager on even.

18. The method according to claim 17, wherein at least one wild card is added to said deck of cards.

19. The method according to claim 17, wherein at least one "lose card" is added to said deck for which the player automatically loses said wager.

20. A method of playing a card game, comprising the steps of:

providing a deck of cards, each card in said deck having a numerical value;

defining a low range of numerical totals, and defining a high range of numerical totals;

a player placing a wager on either (a) said low range of numerical totals, or (b) said high range of numerical totals;

a dealer dealing an odd number of cards;

totaling the numerical values of said dealt cards to obtain a numerical total;

the player winning said wager as follows;

(a) if the numerical total of said dealt cards is within said low range of numerical totals and the player placed a wager on said low range of numerical totals; and, (b) if the numerical total of said dealt cards is within said high range of numerical totals and the player placed a wager on said high range of numerical totals.

21. The method according to claim 20, further including the step of:

defining at least one predetermined numerical total for which the player automatically loses said wager.

22. The method according to claim 20, wherein at least one wild card is added to said deck of cards.

23. The method according to claim 20, wherein at least one "lose card" is added to said deck for which the player automatically loses said wager.

* * * * *